US010451265B2

(12) United States Patent
Alderton

(10) Patent No.: US 10,451,265 B2
(45) Date of Patent: Oct. 22, 2019

(54) BOOK WITH A SUPPORT FOR A LIGHT SOURCE

(71) Applicant: Michael Alderton, Bristol (GB)

(72) Inventor: Michael Alderton, Bristol (GB)

( * ) Notice: Subject to any disclaimer, the term of this patent is extended or adjusted under 35 U.S.C. 154(b) by 0 days.

(21) Appl. No.: 15/592,607

(22) Filed: May 11, 2017

(65) Prior Publication Data

US 2017/0328555 A1 Nov. 16, 2017

(30) Foreign Application Priority Data

May 12, 2016 (GB) ..... 1608390.9

(51) Int. Cl.

| | |
|---|---|
| ***F21V 33/00*** | (2006.01) |
| ***A63H 33/38*** | (2006.01) |
| ***F21V 11/08*** | (2006.01) |
| ***F21V 19/02*** | (2006.01) |
| ***F21V 21/22*** | (2006.01) |
| *F21W 131/30* | (2006.01) |

(52) U.S. Cl.

CPC ..... *F21V 33/0048* (2013.01); *A63H 33/38* (2013.01); *F21V 11/08* (2013.01); *F21V 19/02* (2013.01); *F21V 21/22* (2013.01); *F21W 2131/3005* (2013.01)

(58) Field of Classification Search

None

See application file for complete search history.

(56) References Cited

U.S. PATENT DOCUMENTS

| | | | | |
|---|---|---|---|---|
| 2,605,558 | A * | 8/1952 | Lehner | G09B 17/04 434/183 |
| 4,680,681 | A | 7/1987 | Fisherman et al. | |
| 2009/0298381 | A1 | 12/2009 | Fink | |
| 2016/0046141 | A1 | 2/2016 | Von Letscher | |

FOREIGN PATENT DOCUMENTS

| | | |
|---|---|---|
| KR | 20030048553 | 6/2003 |
| KR | 20100100069 | 9/2010 |

OTHER PUBLICATIONS

UK Intellectual Property Office (UKIPO), Patents Act 1977: Combined Search and Examination Report Under Sections 17 and 18(3), Great Britain Patent Application Serial No. GB1608390.9, dated Aug. 31, 2016.

* cited by examiner

*Primary Examiner* — Vip Patel

(74) *Attorney, Agent, or Firm* — Reichel Stohry LLP; Mark C. Reichel; Natalie J. Dean

(57) ABSTRACT

A book including a bracket for maintaining a light source at a predetermined position such that, in use, the light source, or mobile phone, illuminates at least one pop-up slide included in the book and casts its shadow, and/or projects an image after the light passes through it, onto an adjacent surface, or wall, for viewing thereof.

10 Claims, 5 Drawing Sheets

BOOK WITH A SUPPORT FOR A LIGHT SOURCE

PRIORITY

The present application is related to, and claims the priority benefit of, Great Britain Patent Application Serial No. GB1608390.9 (1608390.9), filed May 12, 2016, the contents of which are expressly incorporated herein by reference and in their entirety.

BACKGROUND

The present invention relates generally to a book and finds particular, although not exclusive, utility in a pop-up book.

The use of a light source to project an image onto a surface by illuminating a slide, transparency or plate is known. The article to be illuminated may also be solid in that light does not pass through. Rather, a shadow of the article may be cast onto the surface.

Books which include transparencies and which may be illuminated with a torch are known, for instance as described in US20090298381. However, the torch must be held in the hand meaning that if the person holding the torch also has to hold the book he has no free hands to turn the pages.

BRIEF SUMMARY

The present invention solves this problem by providing, in a first aspect, a book including a bracket for maintaining a light source at a predetermined position relative to the book such that, in use, the light source illuminates at least one article included in the book and casts its shadow, and/or projects an image after the light passes through it, onto an adjacent surface for viewing thereof.

In this respect the term "book" may include any article which includes one or more pages whether they be bound into the book or loose-leaf.

The light source may be a torch or a mobile phone. Other sources are contemplated.

The predetermined position may be relative to the distance from the at least one article.

The at least one article may include at least one of a translucent, transparent and removed portion. For instance, it may include an image of a zebra on a card where the white stripes of the zebra are cut-out, missing portions of the card.

The translucent portions may include coloured material.

The bracket may be movable relative to the book for stowing of the bracket when not in use and/or for adjusting the size of the cast shadow and/or projected image. For instance, the bracket may move away from and towards the book such that the distance from a light source associated with the bracket to the at least one article may be adjusted as required. If pushed all the way into the book the bracket may be stowed. Other ways of stowing the bracket are contemplated such as folding it across the book and removing it from the book, when not in use. In this regard, the bracket may be removably attachable to the book.

The movement of the bracket relative to the book may also be used to adjust the focus (sharpness) of the cast image.

The bracket may include a support for resting the light source thereon, in use. In this manner the light source may be placed on the support. The support may be a tray which and may possibly be flat or curved to accommodate a torch or mobile phone.

The bracket may include an attachment mechanism for releasably attaching the light source thereto. For instance, the attachment mechanism may include a sucker, a clamp or a strap. The sucker may be used to attach to one of the surfaces of a mobile phone. The clamp may be used to grip a torch. The strap may be used to hold the light source stationary relative to the book and/or it may be used to hold the light source onto the support.

The at least one article may be substantially two dimensional and may be arranged to pop-up from the book as the book is opened. For instance, the at least one article may be a pop-up page.

The bracket may be movable into and out of the book's spine, although other locations for attaching the bracket to the book are contemplated such as across one of the back covers.

The bracket may be arranged such that, in use, with the light source associated with the bracket the light beam is directed across the surface of a page in the book.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
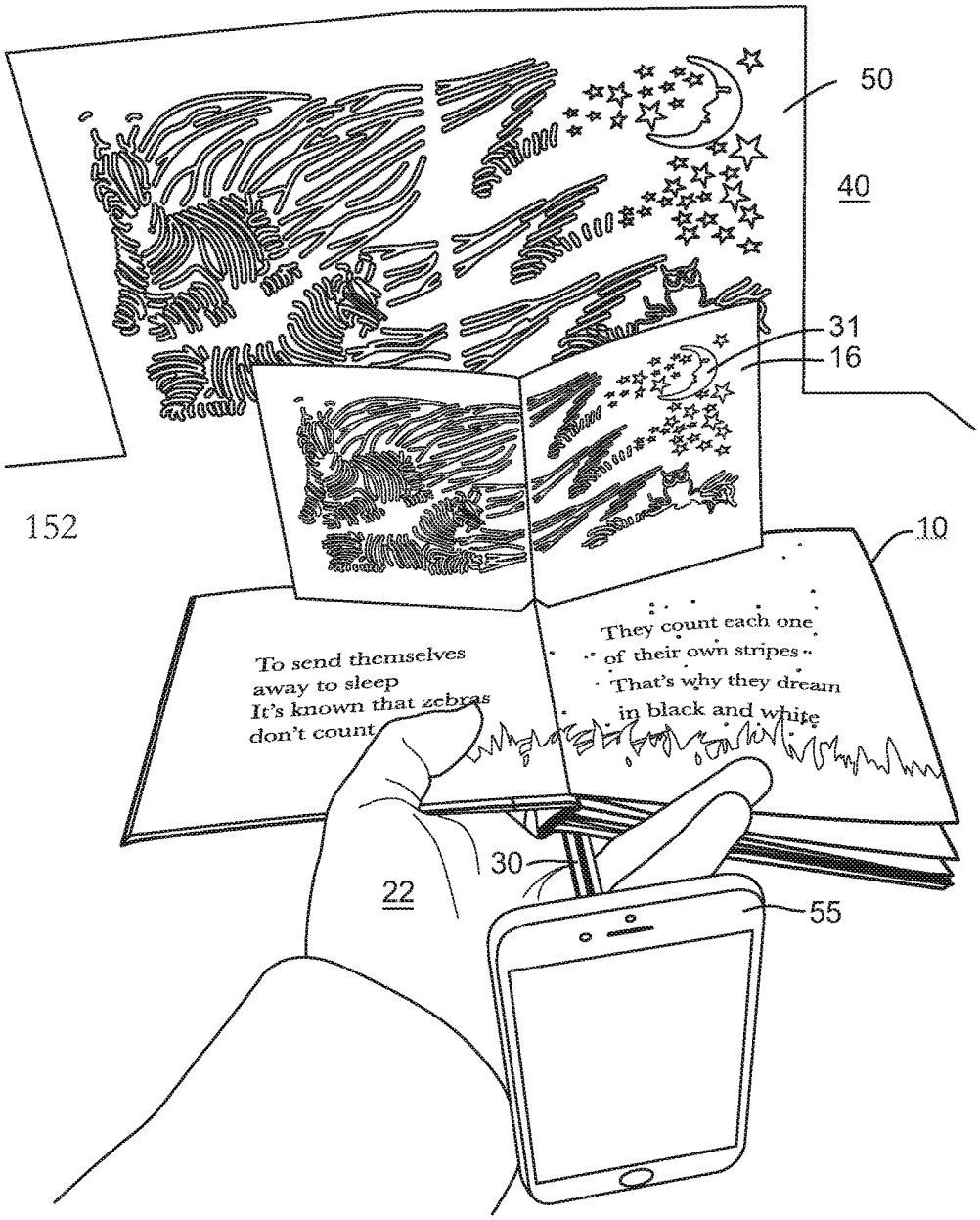
FIG. 1 is a perspective view of a book including a bracket and mobile phone light source projecting an image onto a wall.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

In FIG. 1 a book 10 is shown in the open position with the page surfaces lying in a substantially horizontal plane. A pop-up slide 16 is shown extending upwardly and approximately perpendicularly away from the pages. The slide 16 includes cut-out portions 31 to form shapes such as a moon. A bracket 30 in the form of a rectilinear rod-like member extends from within the spine of the hook in a plane parallel to the surface of the pages. A mobile phone 55 is attached to the end of the bracket 30. The phone's flash is switched on providing a torch-like beam of light which is directed towards the pop-up slide 16.

The book is held near a wall 40 such that the light projects an image 50 onto the wall after passing through and around the slide 16. In this way the image on the slide is enlarged and illuminated.

The book 10 is held with one hand 22 and the light source is attached to the book so that the person's other hand is free turn the pages of the book as the story progresses. The shadow of the left and right hand pages of the book is indicated with reference "152" on the wall 40.

The book may be a children's book.

With the light source attached relatively firmly to the book the book may be oriented in any direction such that the image is cast onto a wall, ceiling or floor. In other words, the image may be cast in a horizontal direction, or a vertical direction, or at any angle therebetween.

Figure 2:
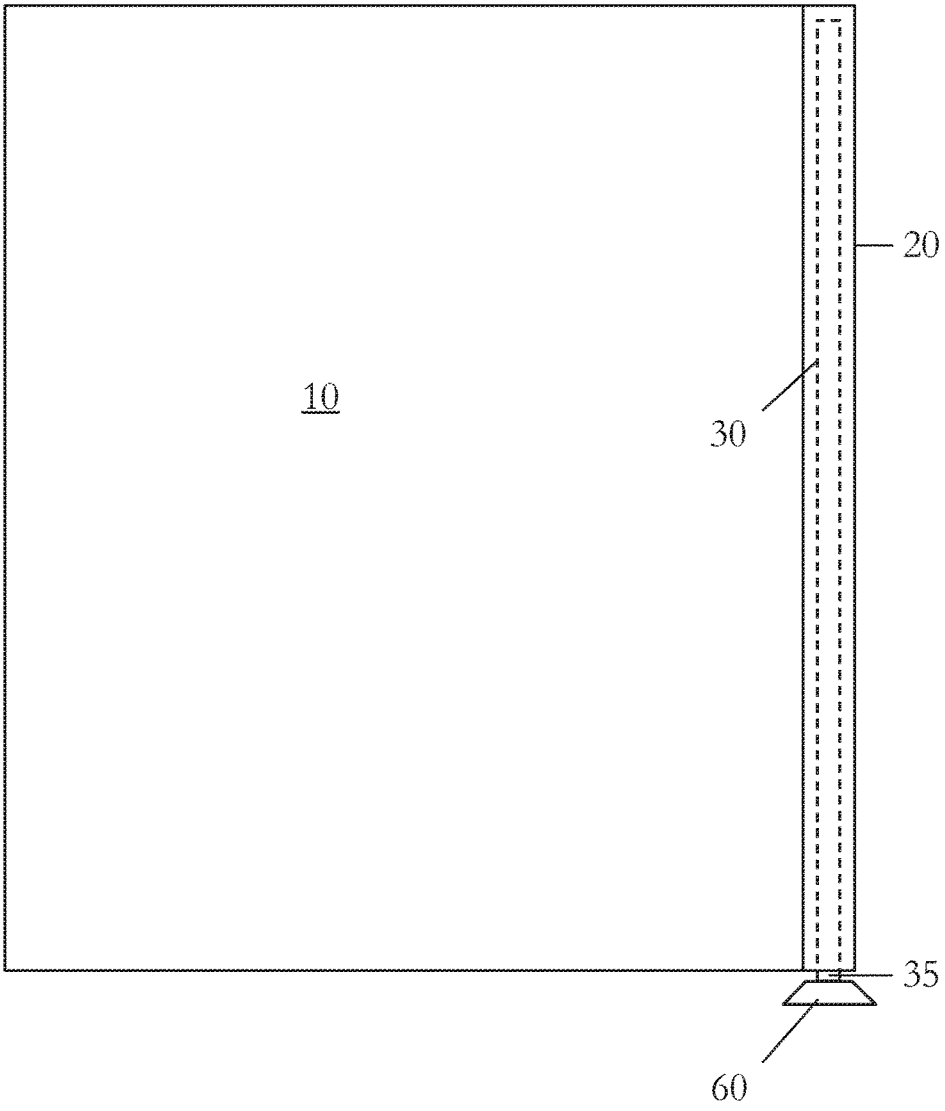
FIGS. 2 and 3 are plan views of the book in FIG. 1 in the closed position with the bracket retracted and extended.

In FIG. 2 a schematic view of the book 10 is shown. The bracket 30 is shown in broken lines within the spine 20 of the book. A short portion 35 extends outwardly from the spine at the end of which is a sucker 60. The sucker 60 may be used to attach the phone 55 to the bracket 30. The sucker 60 may be removable when not required. It may fit into a recess (not shown) provided within the book.

Figure 3:
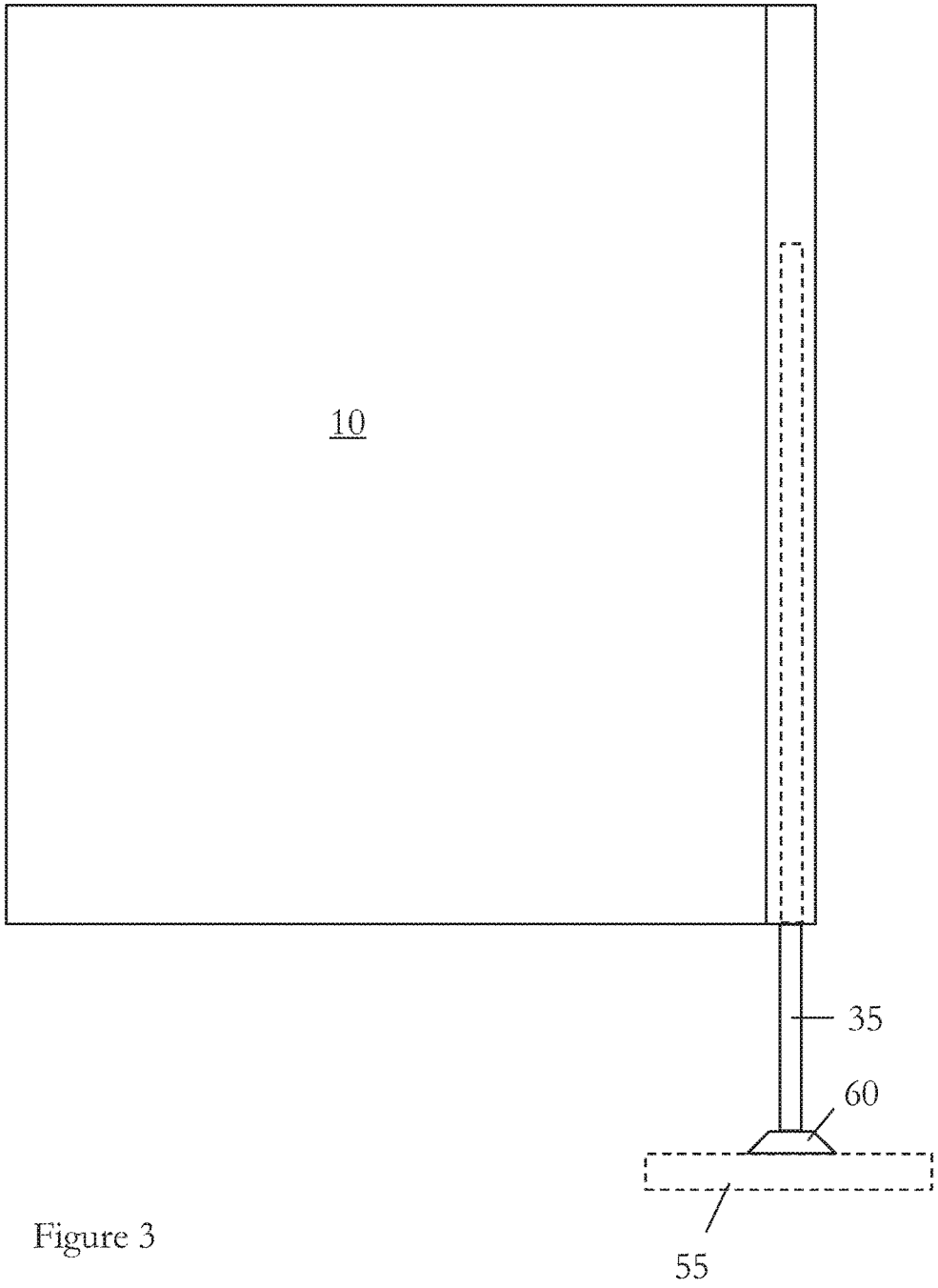

The bracket may be pulled out as shown in FIGS. 1 and 3.

Figure 4:
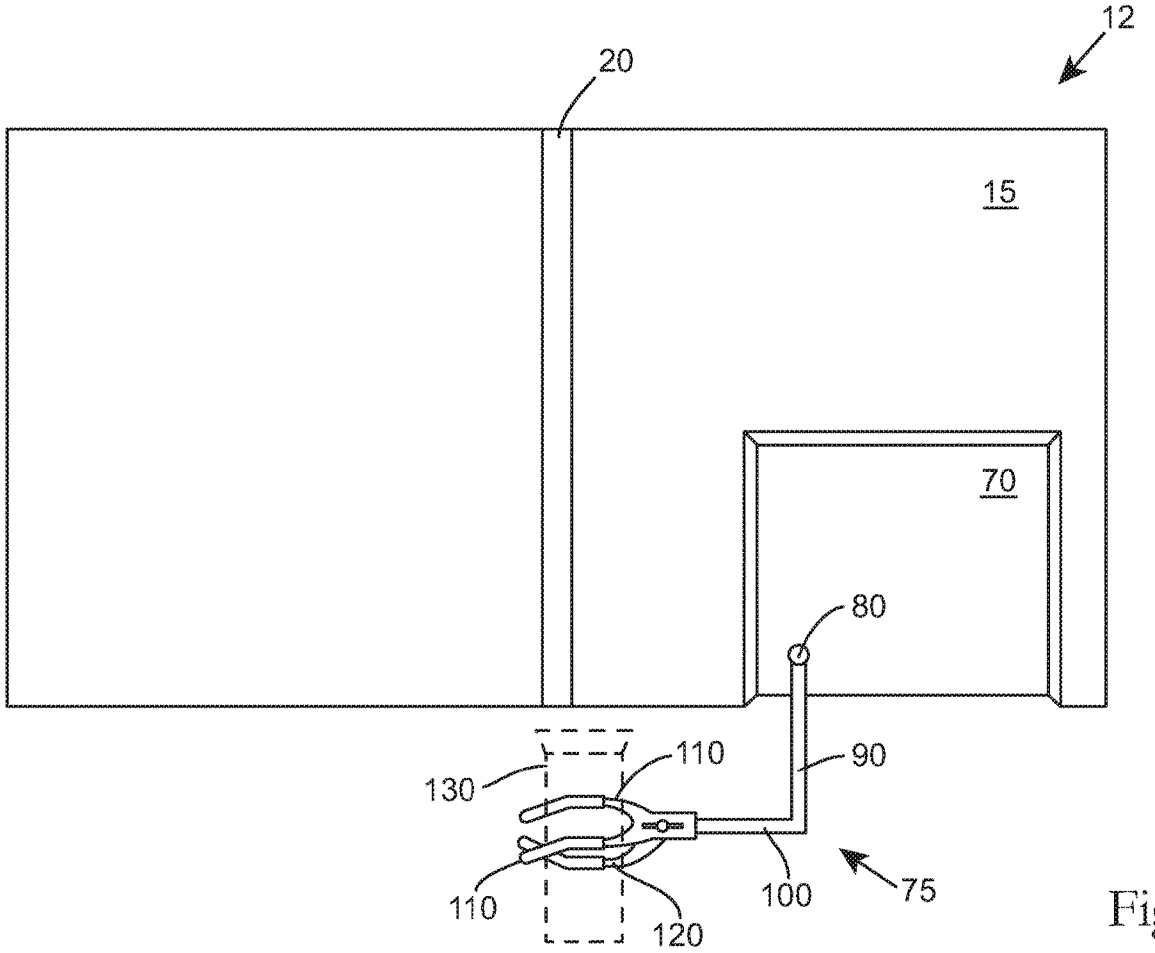
FIG. 4 is a plan view of an alternative book which includes a clamp in a recess in the back cover.

In FIG. 4 an alternative book 12 is shown in the open position. The inside of the rear cover 15 is visible on the right hand side. It includes a recess 70 within which a clamp 75 may be located. The clamp 75 is attached to the rear over by a ball joint 80. It comprises a first arm 90 attached the ball joint 80 and a second arm 100 attached perpendicularly to the distal end of the first arm 90. At the distal end of the second arm a pincer is provided comprising two fingers 110 facing one way and an opposing finger 120 facing the opposite way. The fingers are curved inwardly so as to be able to grip a torch or other such light source between them. The fingers may be sprung, or resiliently biased so that they may be opened to fit in a torch but will then grip the torch. A torch 130 is shown in broken lines to indicate how this may be achieved.

Another ball joint may be provided at the junction of the first 90 and second 100 arms to allow adjustment of the direction of the light source and to allow the clamp 75 to be stowed in the recess 70 when not required.

Either or both of the arms 90, 100 may be telescopic to adjust the distance between the light source and the slide (not shown).

Figure 5:
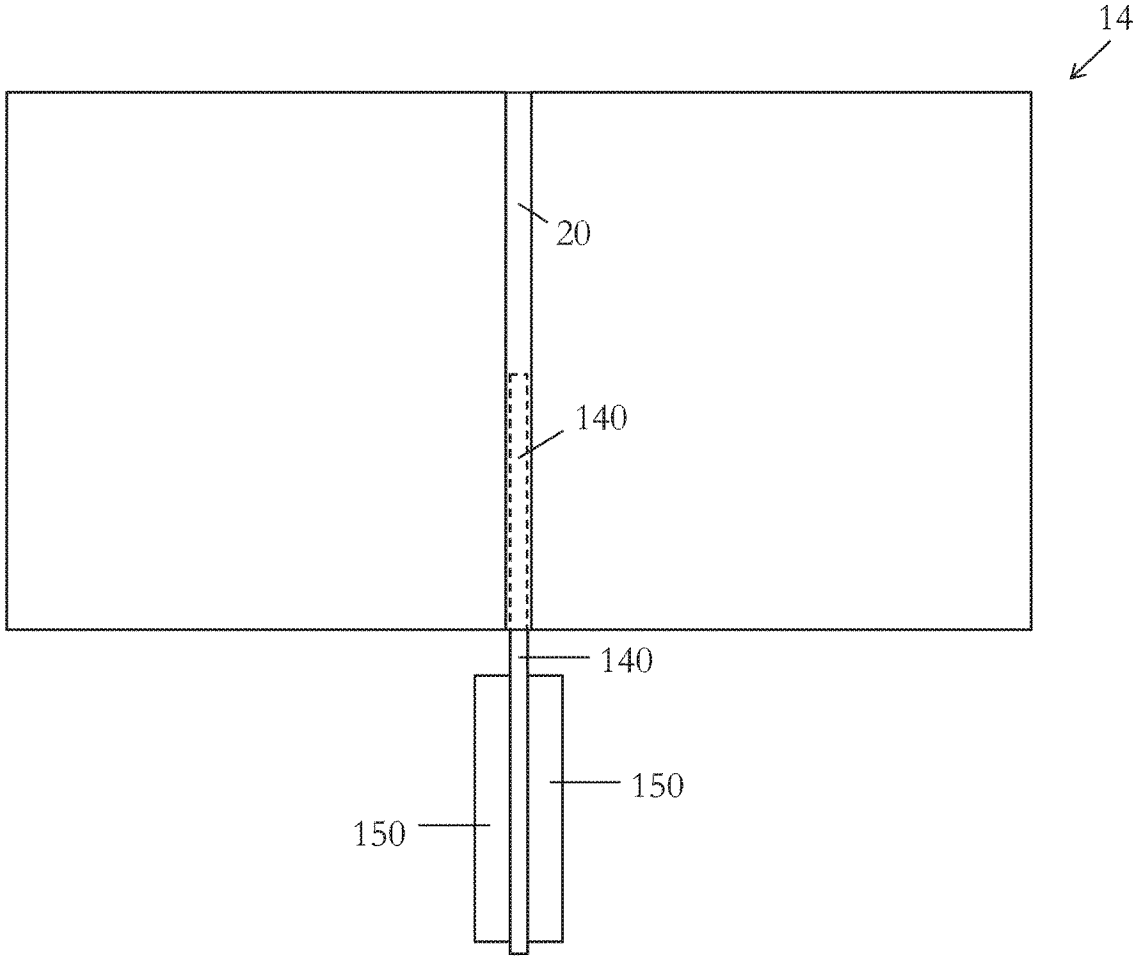
FIG. 5 is a plan view of another alternative book which includes a shelf retractable into the spine of the book.

Another alternative book 14 is shown in FIG. 5. In this case the bracket 140 again fits inside the spine 20 and is extensible from, and retractable into, the spine 20. However, rather than a sucker being provided at the distal end two flaps 150 are movable away from the bracket to form an approximate "V" shape to act as shelf into which a torch may be placed.

Figure 6:
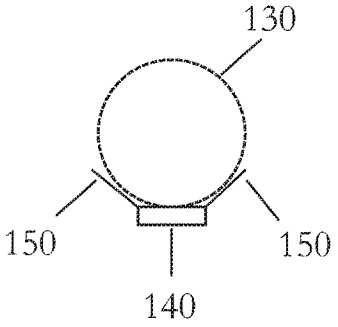
FIG. 6 shows an end-on view of the shelf of FIG. 5 with a torch.

FIG. 6 shows an end-on view of the bracket 140 which has a rectangular cross-section. The two flaps 150 extend from either side of the bracket 140 but may be folded over the bracket when not required to allow the bracket to be stowed inside the spine.

A torch 130 is shown in broken lines indicating how it may be held by the shelf created by the bracket 140 and flaps 150.

The invention claimed is:

1. A book comprising:

at least one slide for providing a projected image when illuminated by a light source;

a bracket having an attachment mechanism for releasably attaching the light source thereto, wherein the bracket is configured to be moveable towards and away from the at least one slide such a distance between the light source and the at least one slide is adjustable to thereby vary size and focus of the projected image.

2. The book according to claim 1, wherein the at least one slide further comprises at least one of a translucent, transparent and removed portion.

3. The book according to claim 1, wherein the book is configured for stowing of the bracket when not in use.

4. The book according to claim 1, wherein the bracket further comprises a support for resting the light source thereon, in use.

5. The book according to claim 1, wherein the attachment mechanism includes a sucker.

6. The book according to claim 1, wherein the attachment mechanism comprises a clamp.

7. The book according to claim 1, wherein the attachment mechanism comprises a strap.

8. The book according to claim 1, wherein the at least one slide is substantially two dimensional and is arranged to pop-up as the book is opened.

9. The book according to claim 1, wherein the bracket is movable into and out of the book's spine.

10. The book according to claim 1, wherein the bracket is arranged such that, in use, with the light source attached to the bracket the light beam is directed across the surface of a page in the book.

* * * * *